US010660361B1

(12) United States Patent
Drennan

(10) Patent No.: US 10,660,361 B1
(45) Date of Patent: May 26, 2020

(54) GREEN SMOKING TIPS AND METHODS OF MANUFACTURE

(71) Applicant: Zachary S. Drennan, Hobbs, NM (US)

(72) Inventor: Zachary S. Drennan, Hobbs, NM (US)

( * ) Notice: Subject to any disclaimer, the term of this patent is extended or adjusted under 35 U.S.C. 154(b) by 699 days.

(21) Appl. No.: 15/360,837

(22) Filed: Nov. 23, 2016

Related U.S. Application Data

(60) Provisional application No. 62/259,550, filed on Nov. 24, 2015.

(51) Int. Cl.

| | |
|---|---|
| ***A24C 5/56*** | (2006.01) |
| ***A24D 3/18*** | (2006.01) |
| ***B27K 5/00*** | (2006.01) |
| ***B27K 9/00*** | (2006.01) |

(52) U.S. Cl.
CPC ..... *A24C 5/565* (2013.01); *A24D 3/18* (2013.01); *B27K 5/0085* (2013.01); *B27K 9/002* (2013.01); *B27K 2240/10* (2013.01)

(58) Field of Classification Search
None
See application file for complete search history.

(56) References Cited

U.S. PATENT DOCUMENTS

2006/0180163 A1* 8/2006 Thompson ..... A24F 13/02 131/175

FOREIGN PATENT DOCUMENTS

JP 2006116433 A * 5/2006

* cited by examiner

*Primary Examiner* — Phu H Nguyen
(74) *Attorney, Agent, or Firm* — Peacock Law P.C.; Justin R. Jackson; Isaac Estrada

(57) ABSTRACT

Green smoking tips and methods of mass manufacturing of green smoking tips comprising extracting volatile compounds and carbonizing hollow plant stem cuts.

15 Claims, 1 Drawing Sheet

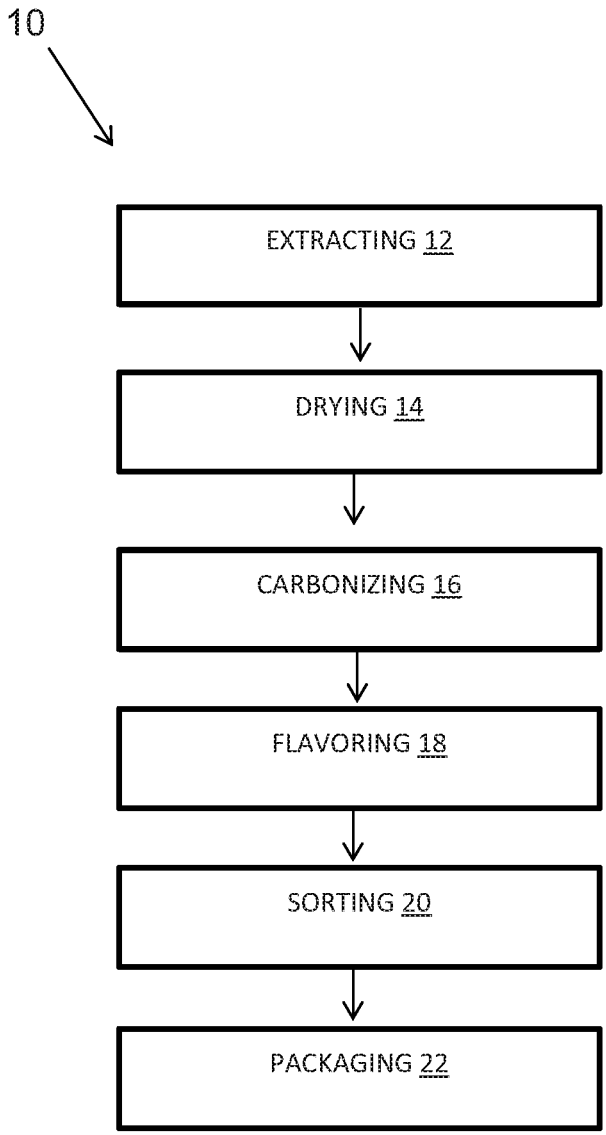
10
EXTRACTING 12
DRYING 14
CARBONIZING 16
FLAVORING 18
SORTING 20
PACKAGING 22

GREEN SMOKING TIPS AND METHODS OF MANUFACTURE

CROSS-REFERENCE TO RELATED APPLICATIONS

This application claims priority to and the benefit of the filing of U.S. Provisional Patent Application No. 62/259,550, entitled "GREEN SMOKING TIPS AND METHODS OF MANUFACTURE", filed on Nov. 24, 2015, and the specification and claims thereof are incorporated herein by reference.

BACKGROUND OF THE INVENTION

Field of the Invention (Technical Field)

The present invention relates to smoking devices, and more particularly, to smoking tips and methods of manufacturing green smoking tips.

Description of Related Art

Smokers often like to roll their own cigarettes with rolling paper. Some like to have a tip for the rolled cigarette so they may improvise a smoking tip out of hard paper, e.g., a piece of a business card, or buy a commercially available smoking tip. Other commercially available tips are manufactured out of materials resistant to heat, such as glass. There is a need for tips made of more environmentally friendly materials, such as bamboo. However, because the heat of the burning cigarette can evaporate compounds in the material, such as volatile compounds, the material has to be treated to make it safe and good tasting to the end user. Embodiments of the present invention solve this problem by providing smoking tips made from, for example, hollow plant stems such as but not limited to bamboo, reed, cane, and the like. In addition, embodiments of the present invention disclose methods of treating such tips to remove volatile compounds that may make the tips unsafe for the user or result in bad flavors.

BRIEF SUMMARY OF THE INVENTION

Embodiments of the present invention comprise methods of mass manufacture of green smoking tips comprising: extracting volatile compounds from plant cuts, and carbonizing the cuts through heat treatment. In one embodiment, the extracting comprises boiling the cuts in a solvent. In one embodiment, the method comprises drying the plant cuts. In one embodiment, the method comprises flavoring the plant cuts with natural or artificial flavors. In one embodiment, the method comprises sorting and packaging the plant cuts.

A different embodiment of the present invention comprises a method of mass manufacture of green smoking tips comprising: cutting hollow plant stems into segments to form plant cuts, extracting the volatile compounds from the plant cuts by boiling them in a solvent, drying the plant cuts, carbonizing the plant cuts by heat treatment, sorting the plant cuts, and packaging the plant cuts. In one embodiment, the method comprises flavoring the plant cuts. In one embodiment, the solvent is ethanol. In another embodiment, the solvent is isopropanol. In one embodiment, the extracting step is conducted until visible rings that first appear at the ends of the plant cuts meet at the center of the length of the plant cuts. In one embodiment, the heat treatment is carried out until the rings that meet at the center of the plant cuts reach the ends of the plant cuts. In one embodiment, the heat treatment is carried out in a convection oven. In one embodiment, the extracting is carried out by supercritical fluid extraction. In one embodiment, the method comprises recovering the solvent for reuse and optionally flavoring the plant cuts.

A different embodiment of the present invention comprises green smoking tips comprising no volatile compounds manufactured according to the steps of a method of the present invention, which are safe and good tasting for the user. In one embodiment, the tips comprise natural flavors.

Further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawing, which is incorporated into and forms a part of the specification, illustrates one or more embodiments of the present invention and, together with the description, serves to explain the principles of the invention. The drawing is only for the purpose of illustrating one or more embodiments of the invention and is not to be construed as limiting the invention. In the drawing:

FIG. 1 is a flow chart of the steps of an embodiment to mass manufacture green smoking tips.

DETAILED DESCRIPTION OF THE INVENTION

In the following detailed description, numerous specific details are set forth in order to provide a thorough understanding of the embodiments of the invention. However, it will be understood by one of ordinary skill in the art that the embodiments may be practiced without these specific details. For instance, well known operation or techniques may not be shown in detail. Technical and scientific terms used in this description have the same meaning as commonly understood to one of ordinary skill in the art to which this subject matter belongs.

As used throughout the specification, the term "green" or "green tech" may refer to environmentally friendly, sustainable, and/or less harmful to the environment production processes or supply chains.

As used throughout the specification, the term "bamboo" refers to woody tropical grasses having hollow woody stems comprising many different strains or species, phenotypes, hybrids thereof and is not limited to any single type. Similarly, as used throughout the specification, the term "reed" refers to woody perennial grasses with hollow slender stems, such as, but not limited to, those of the genera *Arundo* and *Phragmites*.

As used throughout the specification, the term straw refers to for example the dry stalks of cereal plants, such as but not limited to, wheat. As used throughout the specification, the term "sigid vine" refers to hollow, relatively hard structures.

Embodiments of the present invention comprise smoking tips green production processes. In one embodiment, segments ("cuts") of dried hollow plant stems or branches such as poaceae/graminaceous plants, for example, bamboo, reed, cane, grasses, etc., of a suitable diameter are cut to a desirable length to manufacture more natural smoking tips. For example, cuts of between approximately 4 mm and approximately 30 mm in diameter, more preferably between approximately 5 mm and approximately 20 mm in diameter, and most preferably between approximately 6 mm and approximately 14 mm in diameter are preferably prepared. The length of the cuts is preferably between approximately 5 mm and approximately 60 mm, more preferably between approximately 8 mm and approximately 45 mm, and most preferably between approximately 15 mm and approximately 35 mm.

Referring to FIG. 1, in one embodiment, volatile compounds, such as essential oils and the like, are removed from the cut segments in process 10 during extracting 12. In one embodiment, a solvent, such as ethanol or isopropanol, is used to extract such compounds from segments to ensure that users do not inhale any undesirable vapors while smoking.

In one embodiment, a vessel of appropriate size is used to bring the solvent to boil point temperature. The cuts are then placed into the boiling solvent. In this method embodiment, there are some visual indicators for when the segments are ready to proceed to the next step. While the cuts are under boil, they will start to change color (first visual indicator), from the tips inward to the center of the cut. The color will lighten and distinct saturation rings will appear. These saturation rings or lines will start at the tips of the cuts and move inward towards the center as the color of the entire cut also lightens.

Once these two rings meet in the center of the boiling plant cuts, this indicates that the cuts are done and all the plant cuts' essential oils and other volatile compounds have been extracted. In one embodiment, boiling also starts carbonizing process 16 (which is finished by heat treating described in more detail below).

In one embodiment, the cuts are then dried during drying 14, but depending on which solvent is used, this step may be skipped completely. In one embodiment, the drying step 14 is accomplished by leaving the cuts out for the solvent to evaporate. In one embodiment, the cuts are moved into an oven after the solvent evaporates (preventing explosion/fire). In one embodiment, heat treating in the oven is used to complete evaporation of solvents, complete vaporization of oils and other volatile compounds remaining, and to soften the woody structure of the cuts (e.g., carbonizing step 16). In one embodiment, heat treating causes starches left in the plant material to caramelize, resulting in a golden/tan color and a softened touch to users' teeth. In one embodiment, carbonizing 16 further takes brittleness out of the plant cuts. Various heat sources work for this step, but in one embodiment, heat via convection oven is applied.

Similar indicators are displayed by the cuts for their readiness for the next step. In this case, the rings observed in the extraction step move in reverse. These rings migrate outward as the cuts are dried and heated by, for example, convection oven. In one embodiment, the rings reaching the ends of the cuts are used to indicate that the heat treatment has begun, and the carbonization of the bamboo is in its last step. In one embodiment, the cuts start to tan and release a cooking sugar smell. In one embodiment, the cuts continue to be heated until a golden/tan color is achieved. After cooling, the smoking tips are ready for flavoring 18 artificial or natural flavors (such as, but not limited to naturally occurring plant terpenes like alpha-pinene, myrcene, limonene, beta-caryophyllene, linalool, combinations thereof and the like), sorting 20, and then packaging 22.

In a different embodiment, supercritical fluid extraction is used to remove essential oils from the cuts to ensure the user does not receive any off-gassing of plant oil vapors via hot smoke or cinder. In one embodiment, supercritical fluid extraction removes the light oils better than ethanol/alcohol, with the added benefit that a closed loop extractor can be used for the process. In one embodiment, the cuts come out of the closed loop extractor dry and ready for the heat treating step, which eliminates the step of drying. In addition, solvent may be reused, unlike the open process described above, which is somewhat wasteful and dangerous. Solvents suitable for supercritical fluid extraction include, but are not limited to, supercritical fluid extraction ("SFE") grade $CO_2$, liquid oxygen, liquid nitrogen, butane, propane, hexane, dimethyl ether, nitrous oxide, ethylene, propylene and many other hydrocarbons, and the like.

Since closed loop extraction systems are typically made of SAE 304 stainless steel, the visual indicators rings described above cannot be followed. Supercritical fluid extraction varies depending on solvent, but in one embodiment, three things are closely monitored: solvent temperature, material temperature, and solvent pressure.

In one embodiment, the process is started by loading the plant cuts into the material column of a closed-loop extraction apparatus, and in one embodiment the complete system is placed under deep vacuum. Next, the valve to isolate vacuum is closed and the vacuum pump is turned off. In one embodiment, the material column is isolated by closing the bottom dump valve, and solvent is introduced to saturate the plant cuts and fill the material column and extract the oils into the supercritical solution. In one embodiment, after a few minutes (e.g., 10 to 60 minutes depending on the size of the run and the size of the vessel), the solvent is dumped from the material column. Next, the bottom oil collection vessel is in one embodiment chilled with a deep vacuum on it after the dump valve under the material column is opened. The vacuum pulls the solvent/oil solution into the collection vessel. This oil collection vessel acts in two ways: it retains oil and distills solvent for re-use. In one embodiment, the material column is now free to be removed from the system with some vacuum on it from previously dumping the solvent into the collection vessel's vacuum. In one embodiment, the plant cuts come out dry and ready for heat treating.

In order to recover the solvent from the collection tank into a vacuumed solvent storage tank, in one embodiment, the vacuumed solvent storage tank is first chilled. Then the solvent collection tank is heated with warm water and the valve for the chilled tank's vacuum is opened to pull in the solvent as the warm tank pushes the solvent into the chilled solvent storage tank.

In one embodiment, the heat treating step described above is used to complete evaporation of solvents, complete vaporization of oils, and soften the plant cut's structure (carbonization). This causes the starches left in the plant cuts to caramelize and result in a golden/tan color and a softened feel to users' teeth. Carbonizing takes brittleness out of the plant cuts and hardens the exterior surface. In one embodiment, heat treating in the oven is used to complete evaporation of solvents, complete vaporization of oils and other volatile compounds remaining, and to soften the woody structure of the cuts (e.g., carbonization step). In one embodiment, heat treating causes starches left in the plant material to caramelize, resulting in a golden/tan color and a softened touch to users' teeth. Various heat sources work for this step, but in one embodiment, heat via convection oven is applied.

Similar indicators are displayed by the cuts for their readiness for the next step. In this case, the rings observed in the extraction step move in reverse. These rings migrate outward as the cuts are dried and heated by, for example, a convection oven. In one embodiment, the rings reaching the ends of the cuts are used to indicate that the heat treatment has begun, and the carbonization of the bamboo is in its last step. In one embodiment, the cuts start to tan and release a cooking sugar smell. In one embodiment, the cuts continue to be heated until a golden/tan color is achieved. After cooling, the smoking tips are ready for flavoring, sorting, and then packaging.

In a different embodiment, steam is used to extract volatile compounds such as essential oils from plant cuts to prevent users from inhaling these compounds via hot smoke or cinder. In one embodiment, after steaming, the heat treatment step previously described is used to complete evaporation of solvents, complete vaporization of oils, and soften the plant cuts' structure (carbonization). This causes the starches left in the plant cuts to caramelize.

INDUSTRIAL APPLICABILITY

The invention is further illustrated by the following non-limiting examples.

Example 1

Bamboo smoking tips were manufactured by cutting dried bamboo stems to produce segments ("cuts") of 17 mm (original length) and 34 mm (extra-long tip). Stems were chosen for these cuts that had a wall thickness of approximately 1 mm to 2 mm. The cuts were processed to remove volatile compounds such as essential oils from the wood material through boiling solvent (ethanol) extraction. While the cuts were under boil, they changed color from the tips inward to the center of the cut. The color of the cuts lightened and distinct rings appeared; these rings started at the tips of the cuts and moved inward towards the center. Once these two rings met in the center of the boiling plant cuts, the boiling step was completed. The cuts were then left out to dry under an exhaust/vapor vent hood before heat treatment. The cuts were heated in a convection oven at 350° F. The rings began moving outward from the center to the tips of the plant cuts. Heat treatment was stopped after the rings disappeared and the bamboo turned a golden/tan color. The smoking tips thus produced were flavored and packaged according to their approximate diameter in the following fashion:

Micro 6 mm
Small 8 mm
Medium 10 mm
Large 12 mm
King 14 mm

The preceding example can be repeated with similar success by substituting the generically or specifically described reactants and/or operating conditions of this invention for those used in the preceding examples.

Note that in the specification and claims, "about" or "approximately" means within twenty percent (20%) of the numerical amount cited. Although the invention has been described in detail with particular reference to these embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of mass manufacture of green smoking tips comprising:
- cutting hollow plant stems that are between 4 mm and 30 mm in diameter into segments having a length of between 5 mm and 60 mm;
- extracting volatile compounds from the segments by boiling the segments in a solvent; and
- carbonizing the segments through heat treatment by heating the segments after they have been boiled in the solvent until starches in the segments begin to caramelize and the segments turn to a golden/tan color.

2. The method of claim 1 further comprising drying the segments before carbonizing the segments.

3. The method of claim 1 further comprising flavoring the segments.

4. The method of claim 1 further comprising sorting the segments.

5. The method of claim 1 further comprising packaging the segments.

6. The method of claim 1 wherein the extracting is carried out by supercritical fluid extraction.

7. The method of claim 6 further comprising flavoring the segments.

8. A method of mass manufacture of green smoking tips comprising:
- cutting hollow plant stems having a diameter of between 4 mm and 30 mm into segments having a length of between 5 mm and 60 mm;
- extracting volatile compounds from the segments by boiling the segments in a solvent;
- drying the segments;
- carbonizing the segments by heating the segments in an oven after they have been boiled in the solvent until starches in the segments begin to caramelize and the segments turn to a golden/tan color;
- sorting the segments; and
- packaging the segments.

9. The method of claim 8 further comprising flavoring the segments.

10. The method of claim 8 wherein the solvent comprises ethanol.

11. The method of claim 8 wherein the solvent comprises isopropanol.

12. The method of claim 8 wherein the extracting step is conducted until visible rings that first appear at the ends of the segments meet at the center of the length of the segments.

13. The method of claim 8 wherein the heating is carried out until the rings that meet at the center of the segments reach the ends of the segments.

14. The method of claim 8 wherein the heating is carried out in a convection oven.

15. The method of claim 8 further comprising recovering the solvent for reuse.

* * * * *